US011614030B2

(12) United States Patent
Ogura

(10) Patent No.: US 11,614,030 B2
(45) Date of Patent: Mar. 28, 2023

(54) ROTARY BLADE ENGINE

(71) Applicant: Akira Ogura, Tochigi (JP)

(72) Inventor: Akira Ogura, Tochigi (JP)

( * ) Notice: Subject to any disclaimer, the term of this patent is extended or adjusted under 35 U.S.C. 154(b) by 0 days.

(21) Appl. No.: 17/664,081

(22) Filed: May 19, 2022

(65) Prior Publication Data

US 2022/0389860 A1 Dec. 8, 2022

(30) Foreign Application Priority Data

Jun. 8, 2021 (JP) ..... JP2021-096074

(51) Int. Cl.

| | |
|---|---|
| ***F02B 53/04*** | (2006.01) |
| ***F02B 53/06*** | (2006.01) |
| ***F02B 55/02*** | (2006.01) |
| ***F02B 55/08*** | (2006.01) |
| ***F02B 55/14*** | (2006.01) |
| ***F01C 1/44*** | (2006.01) |

(52) U.S. Cl.

CPC ..... *F02B 53/04* (2013.01); *F01C 1/44* (2013.01); *F02B 53/06* (2013.01); *F02B 55/02* (2013.01); *F02B 55/08* (2013.01); *F02B 55/14* (2013.01)

(58) Field of Classification Search

CPC .. F01C 1/44; F02B 53/04; F02B 53/06; F02B 55/02; F02B 55/08; F02B 55/14

See application file for complete search history.

(56) References Cited

U.S. PATENT DOCUMENTS

| | | | | | |
|---|---|---|---|---|---|
| 811,117 | A | * | 1/1906 | Andrews | F01C 1/44 418/221 |
| 4,638,776 | A | * | 1/1987 | Crittenden | F02B 53/04 123/235 |
| 5,352,295 | A | * | 10/1994 | Chou | F01C 1/3441 123/236 |
| 2020/0025063 | A1 | | 1/2020 | Tanaka et al. | |

FOREIGN PATENT DOCUMENTS

| | | | | |
|---|---|---|---|---|
| CN | 107084042 | A | * | 8/2017 |
| CN | 107654291 | A | * | 2/2018 |
| JP | 2020-012411 | A | | 1/2020 |
| JP | 2020-172869 | A | | 10/2020 |

* cited by examiner

*Primary Examiner* — Audrey B. Walter

(74) *Attorney, Agent, or Firm* — Pearne & Gordon LLP

(57) ABSTRACT

Provided is a rotary blade engine including: an outer cylinder; an inner cylinder; an output shaft; an operation chamber; and a blade, wherein the inner cylinder is provided inside the outer cylinder, and rotates about a second center axis as a center of rotation, the second center axis being provided at a position eccentric from a first center axis of an inner peripheral surface of the outer cylinder; the output shaft is inserted into the inner cylinder, and rotates about the first center axis as a center of rotation; the operation chamber is formed between the outer cylinder and the inner cylinder; and the blade is fixed to the output shaft, rotates together with the output shaft, and defines the operation chamber by floatably penetrating the inner cylinder from an inside of the inner cylinder and slidably contacting the inner peripheral surface of the outer cylinder.

6 Claims, 8 Drawing Sheets

ROTARY BLADE ENGINE

CROSS-REFERENCE TO RELATED APPLICATION

This application claims priority from Japanese Patent Application No. 2021-096074 filed with the Japan Patent Office on Jun. 8, 2021, the entire content of which is hereby incorporated by reference.

BACKGROUND

1. Technical Field

The present disclosure relates to a rotary blade engine.

2. Related Art

Typically, a reciprocating engine has been known as an internal combustion engine operating to convert thermal energy obtained by combustion of fuel in a combustion chamber into mechanical energy to rotate an output shaft (e.g., JP-A-2020-172869), for example. The reciprocating engine includes a piston reciprocating in an up-down direction along an inner wall surface of a cylinder forming the combustion chamber. The piston is coupled to the output shaft through a crank mechanism including a connecting rod and a crankshaft. Reciprocation force of the piston is converted into rotation power about the center axis of the output shaft, and the rotation power is output through the crank mechanism.

A rotary piston engine has been known as another example of the internal combustion engine (e.g., JP-A-2020-12411). The rotary piston engine has a rotor housing having a trochoid inner peripheral surface, side housings arranged on both sides of the rotor housing such that the side housings and the rotor housing together form a rotor housing chamber, and a rotor housed in the rotor housing chamber. The rotor is a substantially triangular three-lobe rotor, and divides the rotor housing chamber into three operation chambers. The rotor is supported on an output shaft through an eccentric ring, and revolves about the output shaft while rotating. Rotation power generated in such a manner that three operation chambers move in a peripheral direction by rotation of the rotor and suction, compression, expansion (combustion), and discharge steps are performed in each of three operation chambers is output from the output shaft.

SUMMARY

A rotary blade engine according to an embodiment of the present disclosure includes: an outer cylinder; an inner cylinder; an output shaft; an operation chamber; and a blade. The outer cylinder has a cylindrical inner peripheral surface. The inner cylinder has a cylindrical outer peripheral surface, is provided inside the outer cylinder, and rotates about a second center axis as a center of rotation, the second center axis being provided at a position eccentric from a first center axis of the inner peripheral surface of the outer cylinder. The output shaft is inserted into the inner cylinder, and rotates about the first center axis of the inner peripheral surface of the outer cylinder as a center of rotation. The operation chamber is formed between the inner peripheral surface of the outer cylinder and the outer peripheral surface of the inner cylinder. The blade is fixed to the output shaft, rotates together with the output shaft, and defines the operation chamber by floatably penetrating the inner cylinder from an inside of the inner cylinder and slidably contacting the inner peripheral surface of the outer cylinder.

DETAILED DESCRIPTION

Figure 1:
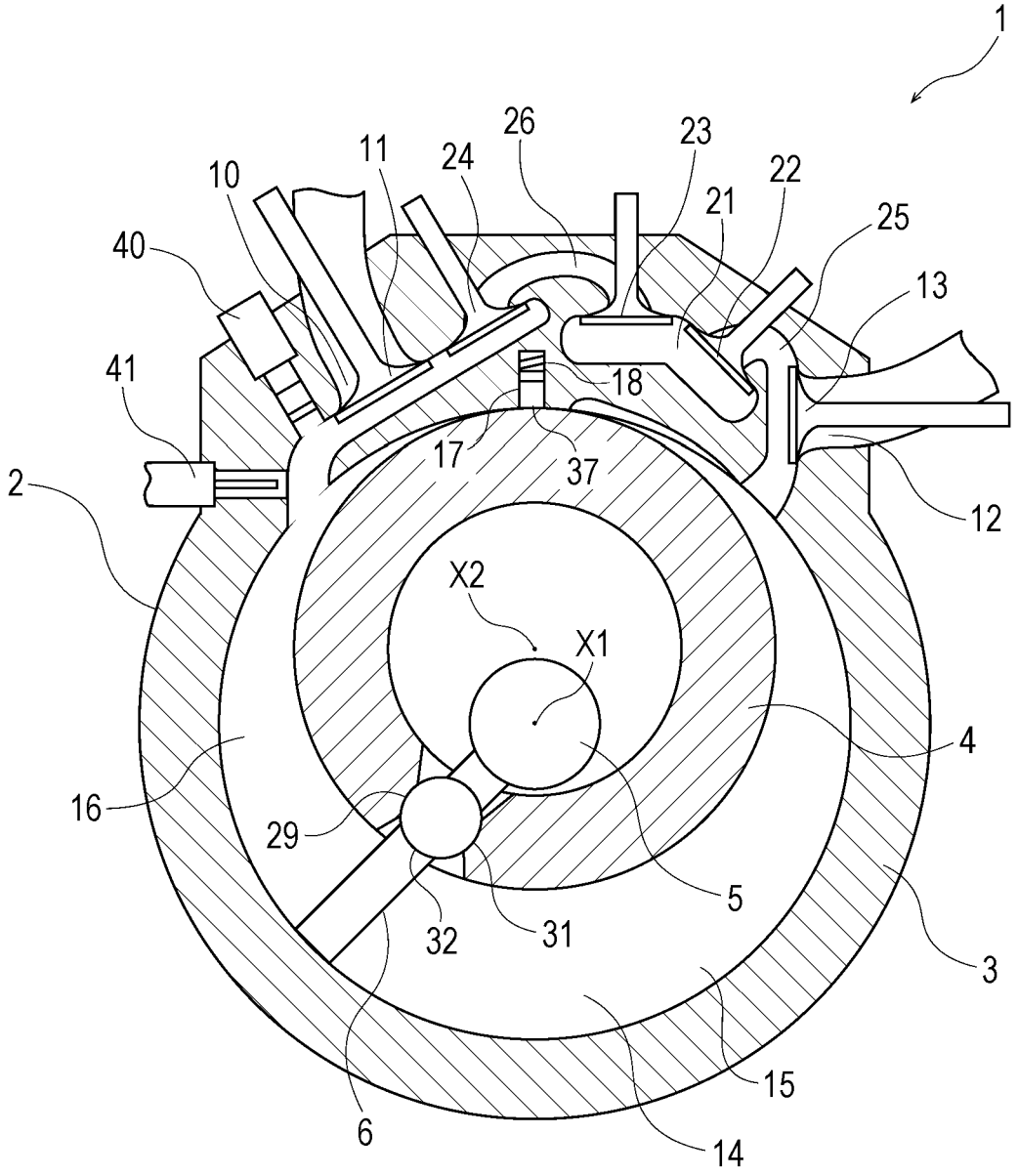
FIG. 1 is a front sectional view showing an outline configuration of a rotary blade engine according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, an engine of a typical technique, such as the reciprocating engine and the rotary piston engine as described above, needs to be improved for enhancing an efficiency.

Specifically, the reciprocating engine transmits, e.g., expansion force of air in an operation chamber to the output shaft by reciprocation of the piston, and uses such expansion force as the rotation power. That is, the reciprocating piston repeats the motion of temporarily stopping during operation to change a movement direction to an opposite direction. For this reason, the reciprocating engine has problems that vibration of the piston is great and stable high-speed operation is difficult to be performed.

Moreover, the reciprocating engine requires a power transmission mechanism, such as the connecting rod and the crankshaft, configured to transmit the power from the reciprocating piston to the output shaft. The reciprocating engine also requires, e.g., a cam mechanism for opening or closing suction and exhaust valves, and the like. For this reason, there is a problem that a loss of power transmission is caused at, e.g., the power transmission mechanism and the cam mechanism. Processing of members forming, e.g., the power transmission mechanism and the cam mechanism as described above and assembly of these mechanisms are not easy.

On the other hand, in the rotary piston engine of the typical technique, the three-lobe rotor configured to transmit the power to the output shaft rotates without reciprocating in response to the pressure of air in the operation chamber. Thus, there are no problems due to reciprocation of the piston as in the reciprocating engine. However, the three-lobe rotor of the rotary piston engine revolves about the output shaft while rotating with supported on the output shaft through the eccentric ring, and for this reason, there is a problem that a load due to eccentric rotation is caused. For enhancing the efficiency of the engine, stable rotation with less fluctuating load on a rotor tip end portion due to such eccentric rotation is required.

Moreover, the rotary piston engine requires a complicated power transmission mechanism, such as an internal gear and an external gear, for transmitting the power from the eccentric ring of the three-lobe rotor to the output shaft. Further, the rotary piston engine is configured such that, e.g., the trochoid inner peripheral surface of the rotor housing and an outer peripheral surface of the three-lobe rotor are in special curved shapes, and high-accuracy processing is required for these surfaces. For this reason, there is a problem that the rotary piston engine is difficult to be produced.

The present disclosure has been made in view of the above-described situations, and an object of the present disclosure is to provide a stably-operable high-efficiency rotary blade engine with an excellent productivity.

A rotary blade engine according to one aspect of the present disclosure includes: an outer cylinder; an inner cylinder; an output shaft; an operation chamber; and a blade. The outer cylinder has a cylindrical inner peripheral surface. The inner cylinder has a cylindrical outer peripheral surface, is provided inside the outer cylinder, and rotates about a second center axis as a center of rotation, the second center axis being provided at a position eccentric from a first center axis of the inner peripheral surface of the outer cylinder. The output shaft is inserted into the inner cylinder, and rotates about the first center axis of the inner peripheral surface of the outer cylinder as a center of rotation. The operation chamber is formed between the inner peripheral surface of the outer cylinder and the outer peripheral surface of the inner cylinder. The blade is fixed to the output shaft, rotates together with the output shaft, and defines the operation chamber by floatably penetrating the inner cylinder from an inside of the inner cylinder and slidably contacting the inner peripheral surface of the outer cylinder.

The rotary blade engine of the present disclosure has the outer cylinder having the cylindrical inner peripheral surface, the inner cylinder provided inside the outer cylinder and having the cylindrical outer peripheral surface, the output shaft inserted into the inner cylinder and rotating about the first center axis of the inner peripheral surface of the outer cylinder as the center of rotation, the operation chamber formed between the inner peripheral surface of the outer cylinder and the outer peripheral surface of the inner cylinder, and the blade fixed to the output shaft and rotating together with the output shaft. The inner cylinder rotates about the second center axis thereof as the center of rotation, the second center axis being provided at the position eccentric from the first center axis of the inner peripheral surface of the outer cylinder. Part of the outer peripheral surface of the inner cylinder is close to the inner peripheral surface of the outer cylinder. The blade defines the operation chamber by floatably penetrating the inner cylinder from the inside of the inner cylinder and slidably contacting the inner peripheral surface of the outer cylinder.

With this configuration, suction, compression, expansion, and discharge steps in the operation chamber can be executed by stable rotation of the inner cylinder about the position eccentric from the output shaft as the center of rotation and stable rotation of the blade about the output shaft as a rotation axis. Thus, the high-efficiency rotary blade engine capable of converting thermal energy of fuel into rotation power for the output shaft by stable operation with less vibration is provided.

Specifically, the rotary blade engine of the present disclosure has no reciprocating power transmission mechanism as in the piston of the reciprocating engine of the typical technique. That is, the inner cylinder of the present disclosure forms the operation chamber, and makes rotary motion with floatably supporting the blade. The blade rotates about the output shaft without reciprocating, and therefore, moves in the operation chamber to press air in the operation chamber and efficiently transmits the pressure of air in the operation chamber to the output shaft. Thus, the rotary blade engine of the present disclosure can rotate the output shaft at high speed with less vibration than that of the reciprocating engine configured to reciprocate the piston, and can achieve high-efficiency energy conversion.

The rotary blade engine of the present disclosure has no mechanism configured to revolve about the output shaft while rotating as in the three-lobe rotor of the rotary piston engine of the typical technique. That is, the inner cylinder of the present disclosure is in a cylindrical shape, rotates about the second center axis as the center of rotation, and rotates at the same position as the center of rotation without moving about a changed position of the center of rotation. Thus, the inner cylinder can stably rotate as compared to the three-lobe rotor of the rotary piston engine.

The rotary blade engine of the present disclosure requires no complicated power transmission mechanism, such as an internal gear and an external gear, configured to transmit power to the output shaft as in the rotary piston engine, and also requires no special high-accuracy curved surface processing such as the trochoid inner peripheral surface. That is, in the rotary blade engine of the present disclosure, the inner cylinder in the cylindrical shape rotates about the second center axis thereof as the center of rotation, and the blade is fixed to the output shaft and rotates about the output shaft as the center of rotation. Thus, the rotary blade engine is configured such that no load is applied to the tip end portion of the blade. Consequently, the rotary blade engine of the present disclosure is easily processed as compared to the rotary piston engine of the typical technique, and is superior in terms of productivity.

Moreover, the rotary blade engine according to one aspect of the present disclosure further includes: a suction port; an exhaust port; a compressed-air chamber; an inlet flow path; and an outlet flow path. The suction port sucks combustion air into the operation chamber from an outside. The exhaust port discharges expanded air from the operation chamber to the outside. The compressed-air chamber stores air compressed in the operation chamber. The inlet flow path is a flow path for air flowing into the compressed-air chamber from the operation chamber, and is connected to the operation chamber in a vicinity of the exhaust port. The outlet flow path is a flow path for air supplied from the compressed-air chamber to the operation chamber, and is connected to the operation chamber in a vicinity of the suction port. The air compressed in the operation chamber flows into and is stored in the compressed-air chamber by way of the inlet flow path, is sent to the operation chamber by way of the outlet flow path, and is expanded in the operation chamber. With this configuration, the suction, compression, expansion, and discharge steps in the operation chamber can be efficiently executed by rotation of the blade.

Moreover, the rotary blade engine according to one aspect of the present disclosure may further include: a suction valve provided at the suction port; an exhaust valve provided at the exhaust port; a compressed-air chamber inlet valve provided at the inlet flow path; and a compressed-air chamber outlet valve provided at the outlet flow path. With this configuration, air backflow and unnecessary air mix in each of the suction, compression, expansion, and discharge steps can be reduced, and high-efficiency energy conversion can be achieved.

Moreover, in the rotary blade engine according to one aspect of the present disclosure, a check valve configured to reduce a backflow of the air flowing into the compressed-air chamber from the operation chamber may be provided at the outlet flow path. With this configuration, in the expansion step, air leakage from the operation chamber to the compressed-air chamber can be reduced, and engine output decline can be suppressed.

Moreover, in the rotary blade engine according to one aspect of the present disclosure, the suction valve, the exhaust valve, the compressed-air chamber inlet valve, and the compressed-air chamber outlet valve may be electromagnetic driving valves. With this configuration, the timing of opening or closing each valve and the degree of opening or closing of each valve can be suitably controlled. Thus, the efficiency of the rotary blade engine can be improved. Moreover, e.g., a cam mechanism for opening or closing each valve is not necessarily provided. Thus, the degree of freedom in arrangement of the valves is high, and the structure of the rotary blade engine is simple. Consequently, the rotary blade engine can be reduced in size and weight. Further, the rotary blade engine can be easily manufactured, and therefore, the productivity thereof can be enhanced.

Moreover, in the rotary blade engine according to one aspect of the present disclosure, the blade divides the operation chamber into a front operation chamber positioned on a front side in a direction of rotation of the blade and a back operation chamber positioned on a back side in the direction of rotation of the blade. In first rotation of the blade, in a state in which the suction valve and the exhaust valve are opened and the compressed-air chamber inlet valve and the compressed-air chamber outlet valve are closed, a suction step of causing air to flow into the back operation chamber from the suction port is executed, and a discharge step of discharging the air from the front operation chamber to the exhaust port is executed. In second rotation of the blade, in a state in which the suction valve, the exhaust valve, and the compressed-air chamber inlet valve are closed and the compressed-air chamber outlet valve is opened, the compressed air is supplied from the compressed-air chamber to the back operation chamber, and a compression step of compressing the air in the front operation chamber is started, and subsequently, in a state in which the compressed-air chamber outlet valve is closed and the compressed-air chamber inlet valve is opened, an expansion step of expanding the air compressed in the back operation chamber is executed, the compression step is executed in the front operation chamber, and the compressed air is sent to the compressed-air chamber. With this configuration, about a single rotation of the expansion step is executed for two rotations of the blade, and therefore, stable rotation output can be obtained.

Hereinafter, a rotary blade engine 1 according to an embodiment of the present disclosure will be described in detail based on the drawings.

FIG. 1 is a front sectional view showing an outline configuration of the rotary blade engine 1 according to the embodiment of the present disclosure.

The rotary blade engine 1 is an internal combustion engine configured to combust fuel such as gasoline, light diesel oil, or hydrogen gas in an operation chamber 14 to convert thermal energy into mechanical energy, thereby outputting the mechanical energy as rotation power for an output shaft 5. The rotary blade engine 1 is used as a drive source for a power generation device, a vehicle, a ship, an agricultural machine, a civil engineering machine, a construction machine, an industrial machine, an air-conditioning device, an air compressor, a pump, and various other devices requiring rotation power.

As shown in FIG. 1, the rotary blade engine 1 has an outer cylinder 3 provided in a housing 2, an inner cylinder 4 provided inside the outer cylinder 3, the output shaft 5 inserted into the inner cylinder 4, and a blade 6 to be rotated with fixed to the output shaft 5.

The outer cylinder 3 is a member forming the operation chamber 14, and has a cylindrical inner peripheral surface. In the outer cylinder 3, the inner cylinder 4 having a cylindrical outer peripheral surface is provided. A region surrounded by the inner peripheral surface of the outer cylinder 3, the outer peripheral surface of the inner cylinder 4, and inner surfaces of side housings 38, 39 (see FIG. 2) serves as the operation chamber 14 configured to suck, compress, expand, and discharge air.

The inner cylinder 4 is rotatably provided at a position eccentric with respect to the outer cylinder 3. That is, the center axis X2 of the inner cylinder 4 is at a position offset from the center axis X1 of the inner peripheral surface of the outer cylinder 3. The center axis X2 of the inner cylinder 4 and the center axis X1 of the outer cylinder 3 are parallel with each other. The inner cylinder 4 rotates counterclockwise as viewed in FIG. 1 about the center axis X2 of the inner cylinder 4 as the center of rotation.

The "center axis X1" may be referred to as the "first center axis". The "center axis X2" may be referred to as the "second center axis".

As described above, the inner cylinder 4 is at the position eccentric with respect to the outer cylinder 3, and part of the outer peripheral surface of the inner cylinder 4 is close to the inner peripheral surface of the outer cylinder 3. A seal member 37 defining the operation chamber 14 is provided in the vicinity of part of the inner peripheral surface of the outer cylinder 3 close to the inner cylinder 4. With this configuration, the operation chamber 14 is in a substantially crescent shape (see FIG. 1) as viewed in a front section between the inner peripheral surface of the outer cylinder 3 and the outer peripheral surface of the inner cylinder 4.

The seal member 37 is fitted in a seal support hole 17 formed at the outer cylinder 3, and an end portion of the seal member 37 on an inner cylinder 4 side slidably contacts the outer peripheral surface of the inner cylinder 4. In the seal support hole 17, an elastic member 18 configured to press the seal member 37 toward the inner cylinder 4, such as a spring, may be provided.

The output shaft 5 is a rotary shaft configured to output the rotation power from the rotary blade engine 1, and is provided coaxially with the center axis X1 of the inner peripheral surface of the outer cylinder 3. The output shaft 5 is provided so as to penetrate a space inside the inner cylinder 4. That is, the output shaft 5 rotates, in the inner cylinder 4, about the center axis X1 of the outer cylinder 3 as the center of rotation. The inner cylinder 4 rotates outside the output shaft 5 about the position offset from the output shaft 5 as the center of rotation. Note that the direction of rotation of the output shaft 5 is a counterclockwise direction as viewed in FIG. 1 as in the inner cylinder 4.

The blade 6 is fixed to the output shaft 5. The blade 6 is a member in a substantially plate shape. The blade 6 floatably penetrates the inner cylinder 4 from the inside thereof, and slidably contacts the inner peripheral surface of the outer cylinder 3 and the inner surfaces of the side housings 38, 39. Thus, the blade 6 divides the operation chamber 14 into a front operation chamber 15 on a front side in the rotation direction and a back operation chamber 16 on a back side in the rotation direction.

The blade 6 is a member configured to rotate together with the output shaft 5 to transmit the pressure of air in the operation chamber 14 to the output shaft 5. Specifically, the blade 6 rotates together with the output shaft 5 to suck air into the operation chamber 14 and compress the air in the operation chamber 14, thereby transmitting the pressure of air combusted and expanded in the operation chamber 14 to the output shaft 5 and discharging the expanded air.

As described above, the output shaft 5 is provided coaxially with the center axis X1 of the inner peripheral surface of the outer cylinder 3, and the blade 6 rotates about the output shaft 5. Thus, a tip end portion of the blade 6 moves in the rotation direction without applying a load on the inner peripheral surface of the outer cylinder 3 in a radial direction.

The inner cylinder 4 is provided with a blade pin 31 configured to floatably support the blade 6. The blade pin 31 is turnably supported on a blade pin support portion 29 of the inner cylinder 4. The blade 6 is slidably fitted in a blade support hole 32 of the blade pin 31.

The housing 2 is formed with a suction port 10 configured to suck combustion air into the operation chamber 14 from the outside, an exhaust port 12 configured to discharge expanded air from the operation chamber 14 to the outside, and a compressed-air chamber 21 configured to store air compressed in the operation chamber 14.

The suction port 10 is formed so as to be connected to the vicinity of one end portion of the operation chamber 14 in the substantially crescent shape as viewed in the front section, specifically the vicinity of the end portion, on the back side in the direction of rotation of the blade 6, of the operation chamber 14, i.e., the vicinity of a left end portion of the operation chamber 14 as viewed in FIG. 1. Note that the suction port 10 may be formed so as to be directly connected to the operation chamber 14 or may be formed so as to be connected to a later-described outlet flow path 26.

On the other hand, the exhaust port 12 is formed so as to be connected to the vicinity of an end portion, on the opposite side of the suction port 10, of the operation chamber 14, specifically the vicinity of the end portion, on the front side in the direction of rotation of the blade 6, of the operation chamber 14, i.e., the vicinity of a right end portion of the operation chamber 14 as viewed in FIG. 1.

The compressed-air chamber 21 is a space for storing high-pressure air compressed in the operation chamber 14. The housing 2 is formed with an inlet flow path 25 as a flow path for air flowing into the compressed-air chamber 21 from the operation chamber 14 and the outlet flow path 26 as a flow path for air supplied from the compressed-air chamber 21 to the operation chamber 14. Specifically, the inlet flow path 25 is connected to the operation chamber 14 in the vicinity of the exhaust port 12, and the outlet flow path 26 is connected to the operation chamber 14 in the vicinity of the suction port 10.

Thus, air compressed in the operation chamber 14 flows into the compressed-air chamber 21 by way of the inlet flow path 25, and then, is stored in the compressed-air chamber 21. After having sent to the operation chamber 14 from the compressed-air chamber 21 by way of the outlet flow path 26 and the vicinity of the suction port 10, the air is expanded in the operation chamber 14. With this configuration, suction, compression, expansion, and discharge steps in the operation chamber 14 can be efficiently executed by rotation of the blade 6.

The suction port 10 is provided with a suction valve 11 configured to open or close the suction port 10 to control air suction into the operation chamber 14. On the other hand, the exhaust port 12 is provided with an exhaust valve 13 configured to open or close the exhaust port 12 to control air discharge from the operation chamber 14.

In an inlet of the compressed-air chamber 21, i.e., in the vicinity of an opening of the inlet flow path 25 on a compressed-air chamber 21 side, a compressed-air chamber inlet valve 22 configured to open or close the inlet flow path 25 to control the flow of compressed air from the operation chamber 14 to the compressed-air chamber 21 is provided. In an outlet of the compressed-air chamber 21, i.e., in the vicinity of an opening of the outlet flow path 26 on the compressed-air chamber 21 side, a compressed-air chamber outlet valve 23 configured to open or close the outlet flow path 26 to control the flow of compressed air from the compressed-air chamber 21 to the operation chamber 14 is provided.

The rotary blade engine 1 includes the suction valve 11, the exhaust valve 13, the compressed-air chamber inlet valve 22, and the compressed-air chamber outlet valve 23, and therefore, can reduce air backflow and unnecessary air mix in each of the suction, compression, expansion, and discharge steps and can achieve high-efficiency energy conversion.

At the outlet flow path 26, a check valve 24 configured to open or close at the substantially same timing as that of the compressed-air chamber outlet valve 23 to reduce the backflow of air from the operation chamber 14 to the compressed-air chamber 21 is provided. Thus, leakage of expanded air from the operation chamber 14 to the compressed-air chamber 21 in an expansion step S4 is reduced, and therefore, engine output decline can be suppressed.

The suction valve 11, the exhaust valve 13, the compressed-air chamber inlet valve 22, the compressed-air chamber outlet valve 23, and the check valve 24 as described above may be, for example, electromagnetic driving valves using DC motors as a drive source. With the electromagnetic driving valves, the timing of opening or closing each valve and the degree of opening or closing, i.e., the lift amount, of each valve can be suitably controlled. Thus, the efficiency of the rotary blade engine 1 can be improved.

Moreover, the electromagnetic driving valves are used as the suction valve 11, the exhaust valve 13, the compressed-air chamber inlet valve 22, the compressed-air chamber outlet valve 23, and the check valve 24, and therefore, e.g., a cam mechanism for opening or closing each valve is not necessarily provided. Thus, the degree of freedom in arrangement of the suction valve 11, the exhaust valve 13, the compressed-air chamber inlet valve 22, the compressed-air chamber outlet valve 23, and the check valve 24 is high, and the structure of the rotary blade engine 1 is simple. Consequently, the entire device can be reduced in size and weight. Moreover, the rotary blade engine 1 can be easily manufactured, and therefore, the electromagnetic driving valve is preferable in terms of productivity.

The housing 2 is provided with a fuel injection device 40 configured to supply fuel to compressed air and an ignition plug 41 configured to ignite fuel. Specifically, the fuel injection device 40 and the ignition plug 41 are provided such that fuel is injected into the operation chamber 14 or the outlet flow path 26 in the vicinity of the suction port 10 and ignited therein. The fuel injection device 40 is, for example, a computerized fuel injection device configured to inject fuel by electronic control.

Figure 2:
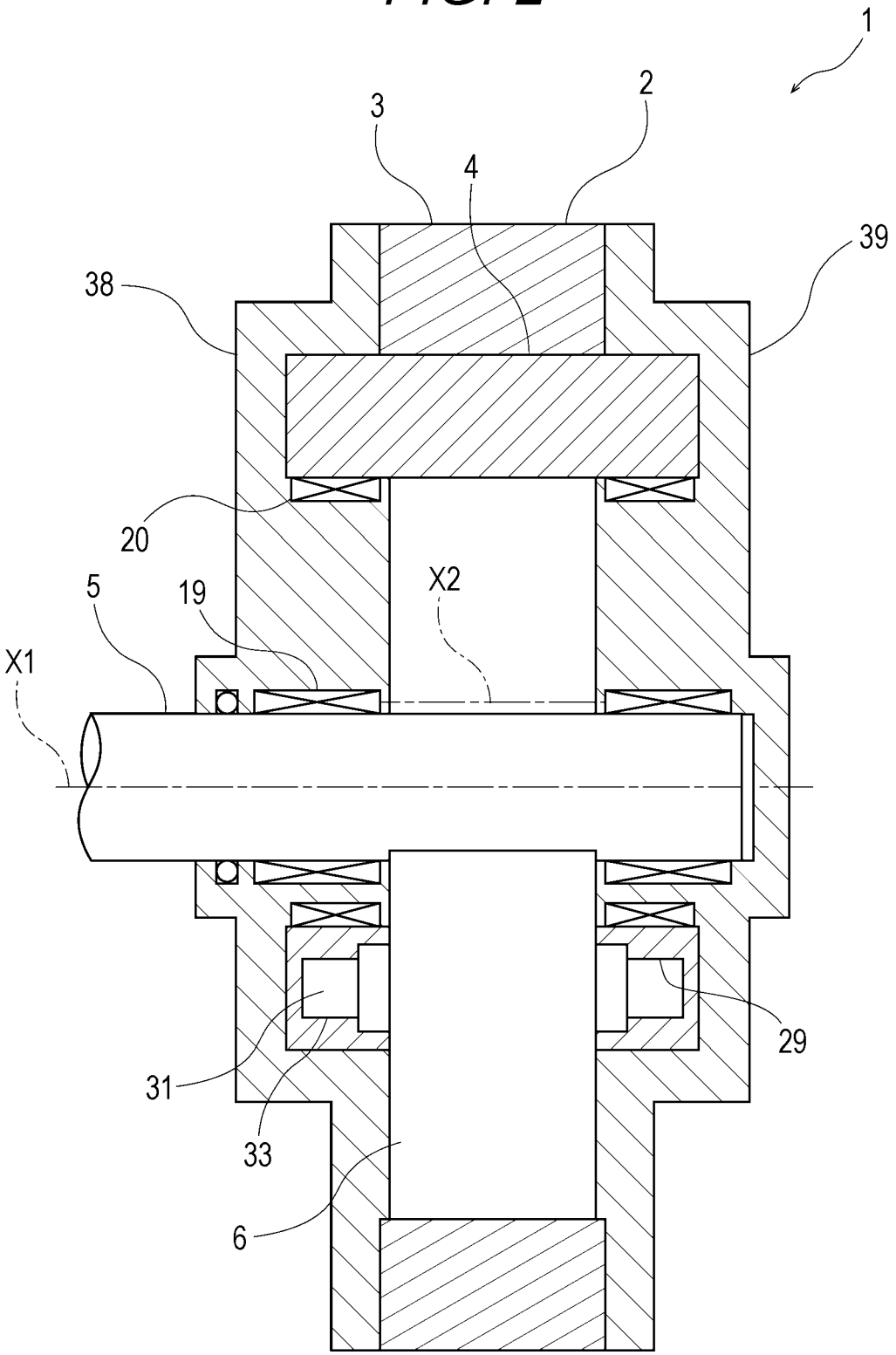
FIG. 2 is a side sectional view showing the outline configuration of the rotary blade engine according to the embodiment of the present disclosure.

FIG. 2 is a side sectional view showing the outline configuration of the rotary blade engine 1.

Referring to FIG. 2, the housing 2 includes the outer cylinder 3 having the cylindrical inner peripheral surface. The pair of side housings 38, 39 is fixed to both sides of the outer cylinder 3 in the direction of the center axis X1 of the outer cylinder 3.

The inner cylinder 4 is provided in a region surrounded by the outer cylinder 3 and the side housings 38, 39. The region surrounded by the inner peripheral surface of the outer cylinder 3, the outer peripheral surface of the inner cylinder 4, and the inner surfaces of the side housings 38, 39 serves as the operation chamber 14 (see FIG. 1).

As described above, the inner cylinder 4 is turnable about the position offset from the center axis X1 of the outer cylinder 3 as the center of rotation. Specifically, bearings 20 are provided on an inner diameter side in the vicinity of both ends of the inner cylinder 4 in the direction of the center axis X2 of the inner cylinder 4. The inner cylinder 4 is rotatably supported on the side housings 38, 39 through the bearings 20. Note that a seal member (not shown) slidably contacting the inner cylinder 4 to reduce air leakage is provided between a side surface of the inner cylinder 4 and each of the side housings 38, 39.

The output shaft 5 is provided coaxially with the center axis X1 of the inner peripheral surface of the outer cylinder 3, and is provided so as to penetrate the inside of the inner cylinder 4. Specifically, the output shaft 5 is supported on the side housings 38, 39 through bearings 19 so as to rotate about the center axis X1 of the outer cylinder 3 as the center of rotation.

The blade 6 configured to rotate together with the output shaft 5 is fixed to the output shaft 5. The blade 6 protrudes into the operation chamber 14 through the inner cylinder 4, and slidably contacts the inner peripheral surface of the outer cylinder 3. Specifically, the blade 6 is slidably and turnably supported on the inner cylinder 4 through the blade pin 31.

Figure 3A:
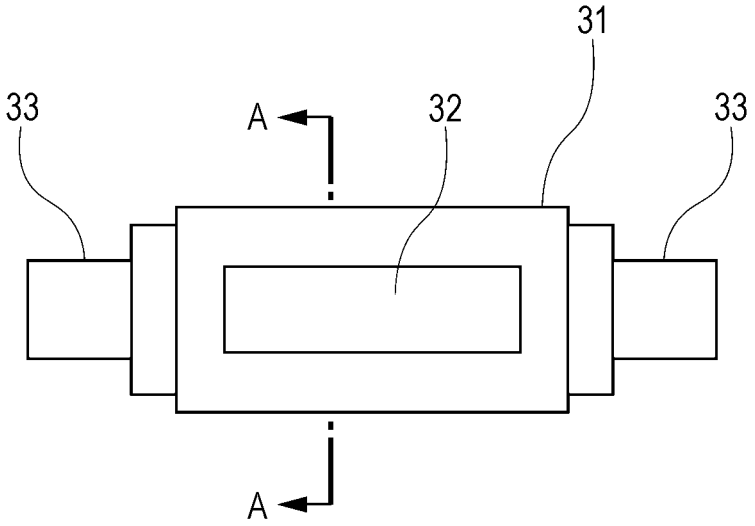
FIG. 3A is a side view showing an outline configuration of a blade pin of the rotary blade engine according to the embodiment of the present disclosure.
Figure 3B:
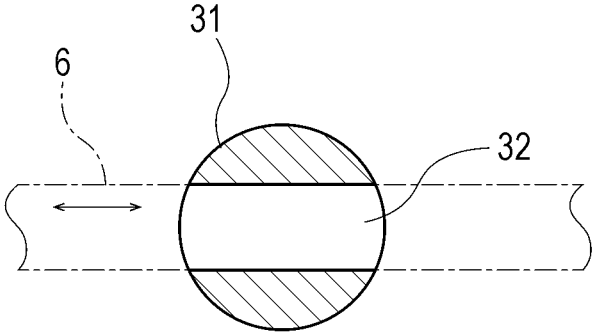
FIG. 3B is a sectional view along an A-A line of FIG. 3A, FIG. 3B showing the outline configuration of the blade pin of the rotary blade engine according to the embodiment of the present disclosure.

FIGS. 3A and 3B are views showing the outline of the blade pin 31, and FIG. 3A is a side view and FIG. 3B is a sectional view along an A-A line of FIG. 3A.

As shown in FIGS. 3A and 3B, the blade pin 31 is in a substantially circular columnar shape. The blade pin 31 is a member provided at the inner cylinder 4 (see FIG. 2) and slidably supporting the blade 6 (see FIG. 1). The blade pin 31 is formed with the blade support hole 32 into which the blade 6 is to be inserted.

The blade support hole 32 is, corresponding to the sectional shape of the blade 6, in a substantially rectangular shape as viewed in a section. The blade support hole 32 is formed so as to penetrate the blade pin 31 from one side to the other side of a peripheral surface of the blade pin 31. The blade 6 is fitted in the blade support hole 32, and is slidably supported on the blade support hole 32.

At both end portions of the blade pin 31, support shaft portions 33 to be fitted in the blade pin support portion 29 (see FIG. 2) of the inner cylinder 4 are formed. As shown in FIG. 2, the support shaft portions 33 are turnably fitted in the blade pin support portion 29.

Figure 4:
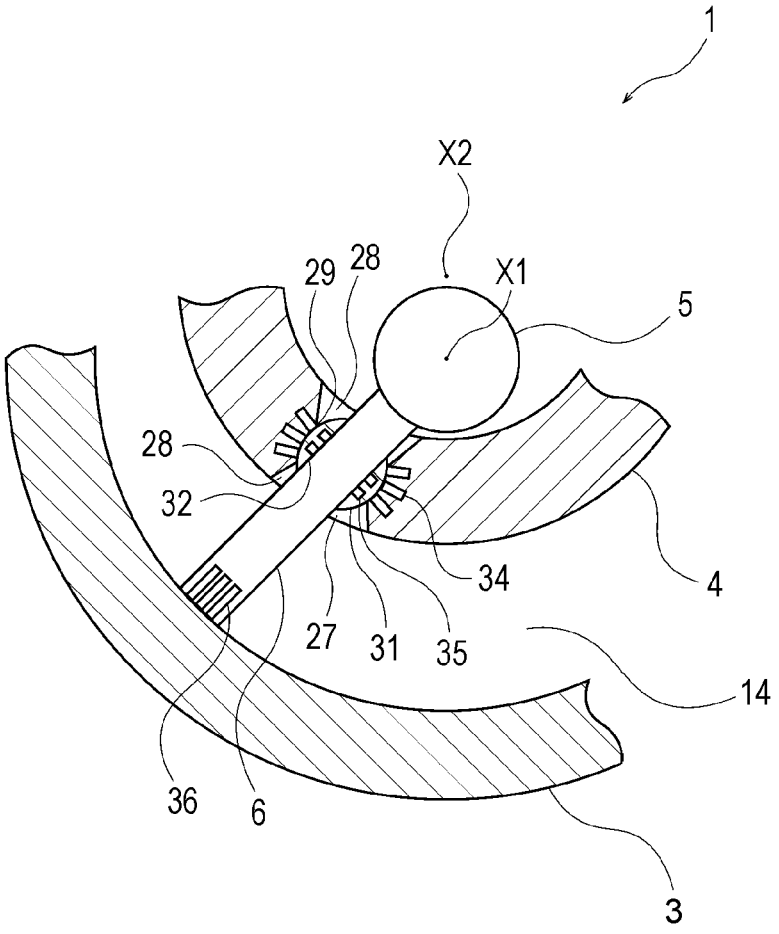
FIG. 4 is a front sectional view showing the outline of the vicinity of a blade and the blade pin of the rotary blade engine according to the embodiment of the present disclosure.

FIG. 4 is a front sectional view showing the outline of the vicinity of the blade pin 31 of the rotary blade engine 1.

As shown in FIG. 4, the blade pin 31 is turnably provided in an opening 27 formed at the inner cylinder 4. The opening 27 is formed so as to penetrate from the inside of the inner cylinder 4 to the outside of an outer peripheral portion of the inner cylinder 4. As described above, the blade pin 31 is formed with the blade support hole 32 penetrating the inner cylinder 4 from the inside to the outside, and the blade 6 is slidably fitted in the blade support hole 32.

Expanded portions 28 are formed at the opening 27 of the inner cylinder 4. The expanded portions 28 are formed on inner and outer peripheral sides of the inner cylinder 4 such that the opening area of the opening 27 increases. With this configuration, a space where the blade 6 is turnable is ensured between the blade 6 fitted in the blade pin 31 and the opening 27. That is, the blade 6 does not contact the opening 27 of the inner cylinder 4 even during turning.

With this configuration, the blade 6 penetrates the inner cylinder 4 from the inside to the outer peripheral surface and is slidable in an in-out direction of the inner cylinder 4, and inclination of the blade 6 with respect to a peripheral direction of the inner cylinder 4 is changeable.

Seal members 34 as blade pin seals are provided between an outer peripheral surface of the blade pin 31 and the blade pin support portion 29. With the seal members 34, the outer peripheral surface of the blade pin 31 is sealed, and air leakage from the operation chamber 14 in an inward direction of the inner cylinder 4 or in the opposite direction thereof is reduced.

Seal members 35 as blade pin seals are provided between each of front and back surfaces of the blade 6 and the blade support hole 32 of the blade pin 31. With the seal members 35, both the front and back surfaces of the blade 6 are sealed, and air leakage from the operation chamber 14 in the inward direction of the inner cylinder 4 or in the opposite direction thereof is reduced.

Apex seals 36 configured to slidably seal between a tip end of the blade 6 and the inner peripheral surface of the outer cylinder 3 are provided in the vicinity of the tip end of the blade 6. In other words, the blade 6 slidably contacts the inner peripheral surface of the outer cylinder 3 through the apex seals 36.

Note that as described above, the blade 6 rotates about the output shaft 5 coaxial with the center axis X1 of the inner peripheral surface of the outer cylinder 3, and therefore, the tip end portion of the blade 6 does not apply a load on the inner peripheral surface of the outer cylinder 3 in the radial direction. Thus, the blade 6 can be rotatably operated with a high efficiency and less friction of the tip end portion.

A side seal (not shown) configured to slidably seal between the blade 6 and each of the inner surfaces of the side housings 38, 39 (see FIG. 2) is provided at a side end portion of the blade 6. In other words, the blade 6 slidably contacts the inner surfaces of the side housings 38, 39 through the side seals.

As described above, the seal members 34, 35, the apex seals 36, and the side seal are provided at, e.g., a sliding portion of the blade 6 so that degradation of a thermal efficiency due to air leakage can be reduced and the efficiency of the rotary blade engine 1 can be enhanced.

Next, operation of the rotary blade engine 1 will be described in detail with reference to FIGS. 5 to 7.

Figure 5:
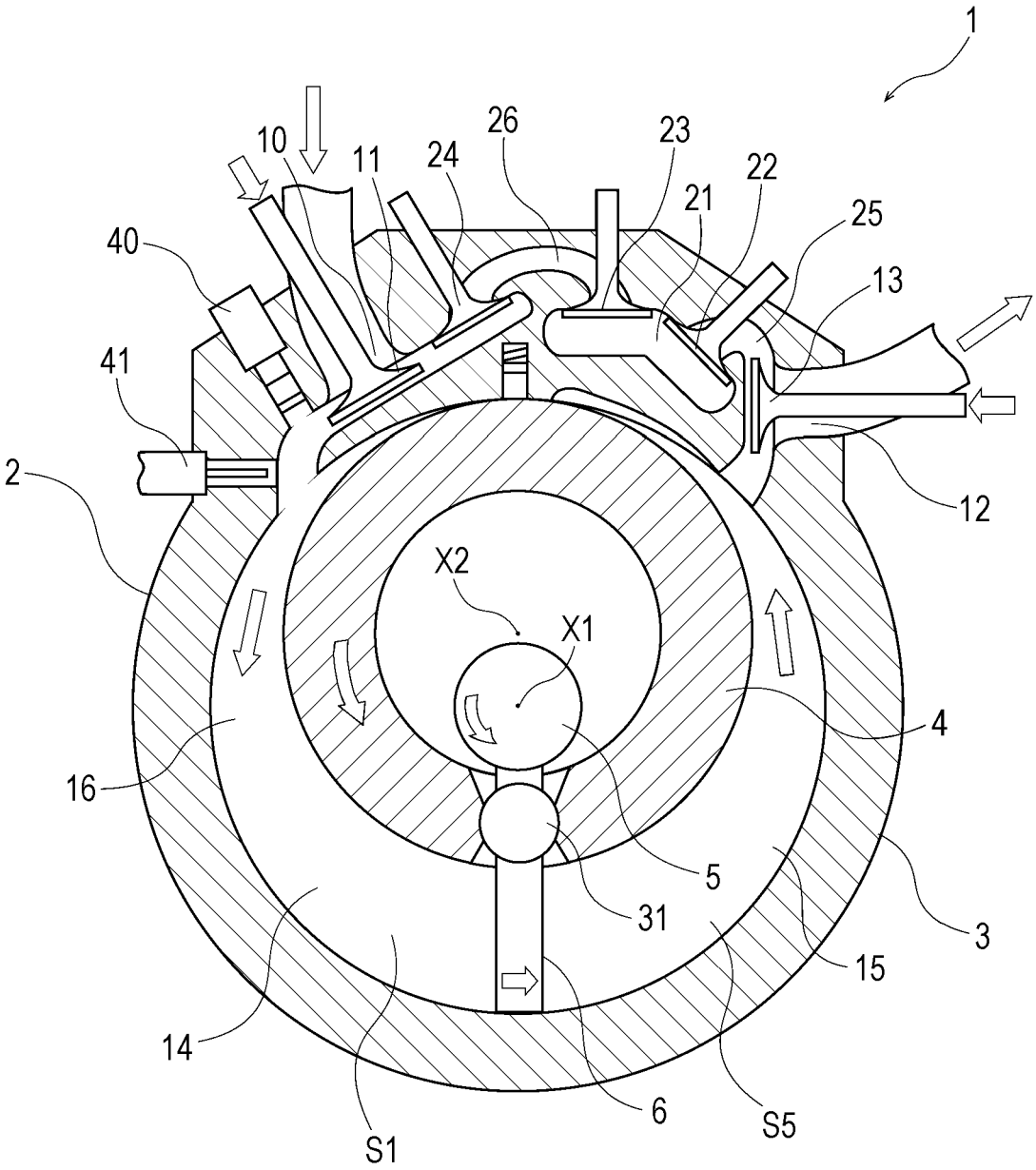
FIG. 5 is a view showing a suction step and a discharge step in the rotary blade engine according to the embodiment of the present disclosure.

FIG. 5 is a view showing a suction step S1 and a discharge step S5 in the rotary blade engine 1.

Figure 6:
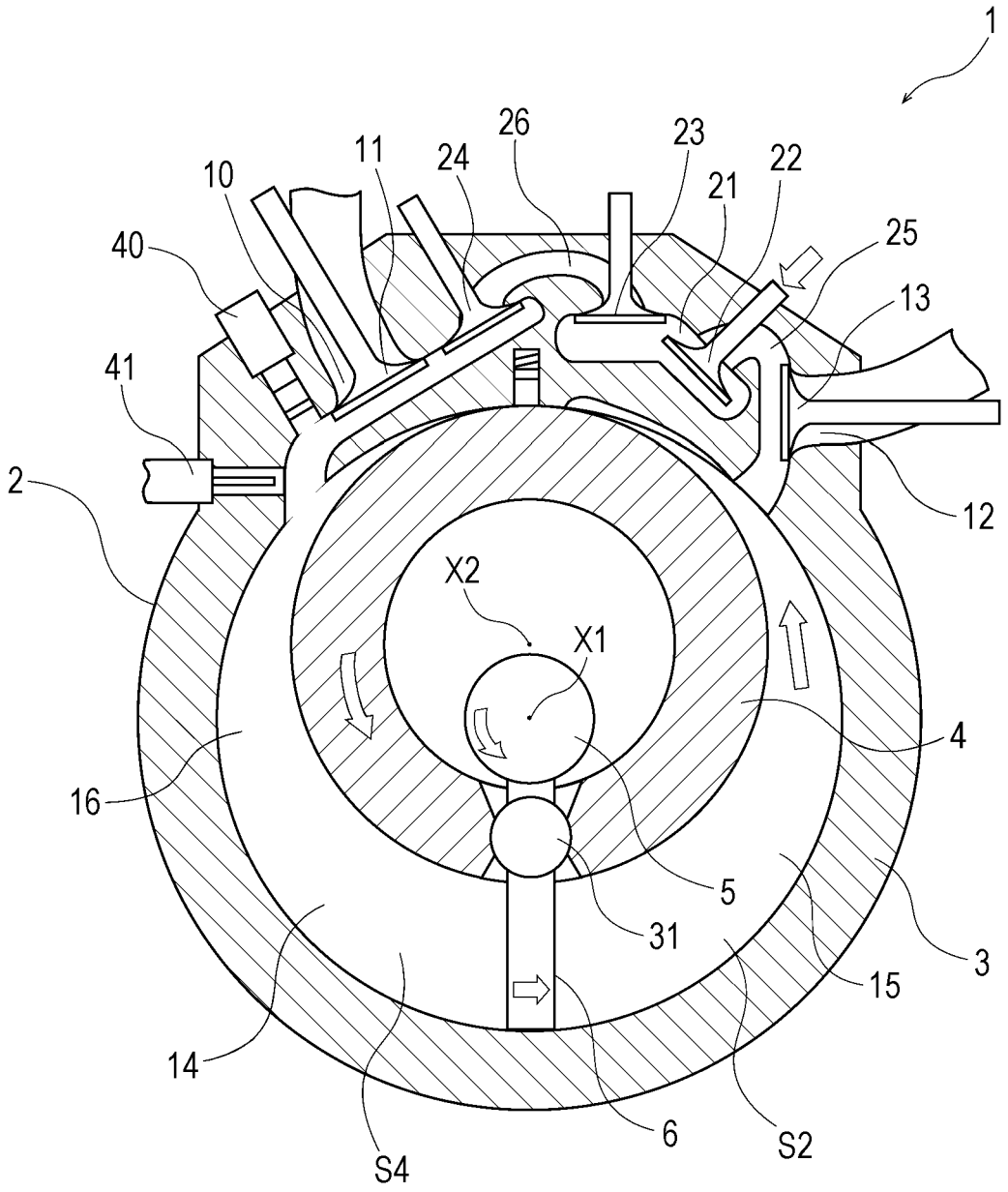
FIG. 6 is a view showing a compression step and an expansion step in the rotary blade engine according to the embodiment of the present disclosure.
Figure 7:
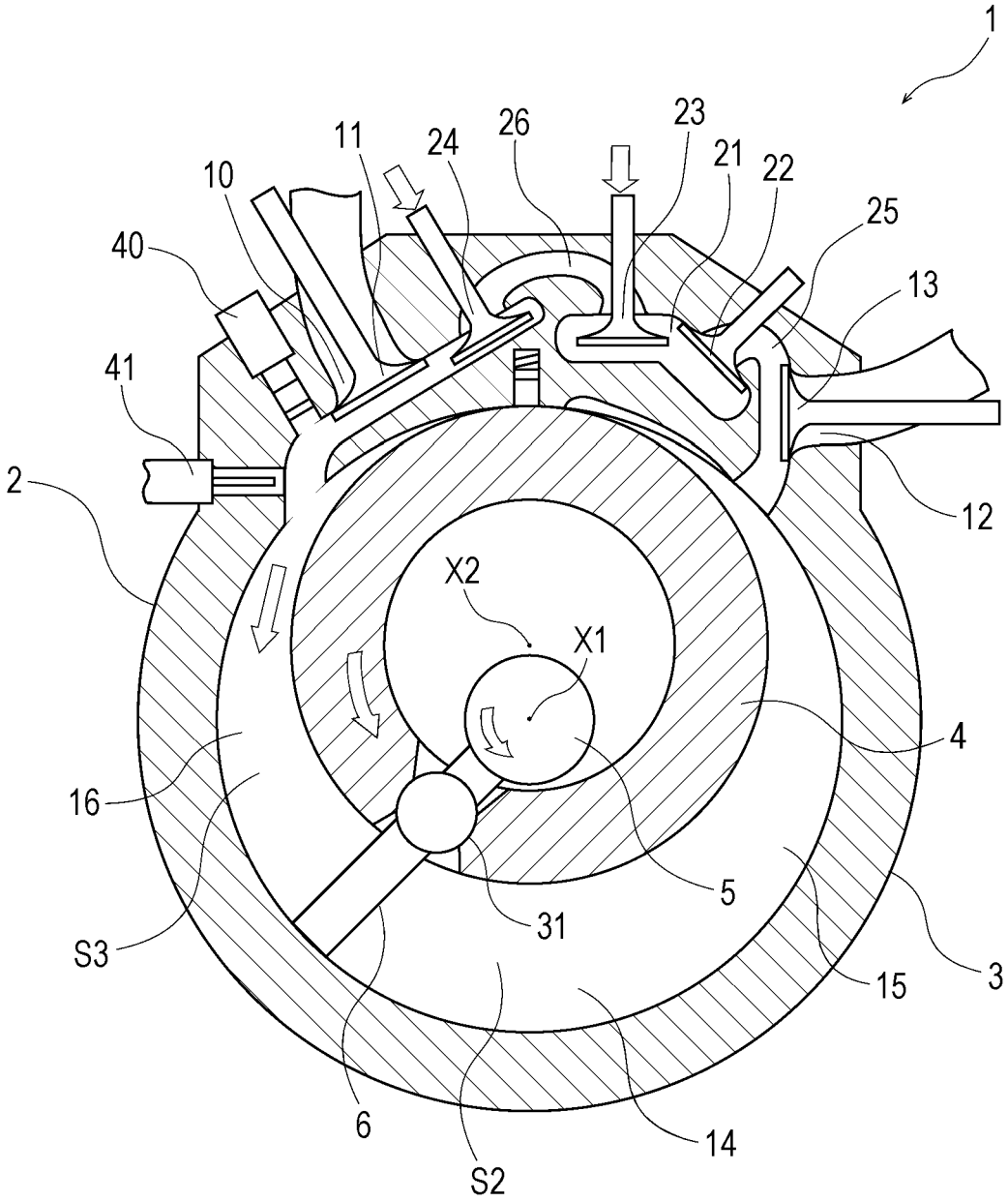
FIG. 7 is a view showing a compressed-air sending step in the rotary blade engine according to the embodiment of the present disclosure.

In FIGS. 5 to 7, the output shaft 5 rotates counterclockwise about the center axis X1 of the outer cylinder 3 as the center of rotation. In operative connection with rotation of the output shaft 5, the inner cylinder 4 rotates counterclockwise about the center axis X2, which is at the position eccentric from the output shaft 5, of the inner cylinder 4 as the center of rotation.

Referring to FIG. 5, the suction step S1 will be described. After the blade 6 rotating together with the output shaft 5 has passed through the vicinity of the suction port 10 and the outlet flow path 26, the suction step S1 is executed. In the suction step S1, the blade 6 rotates in a state in which the suction valve 11 and the exhaust valve 13 are opened and the compressed-air chamber inlet valve 22, the compressed-air chamber outlet valve 23, and the check valve 24 are closed. Accordingly, air is sucked into the back operation chamber 16 on the back side of the blade 6 from the suction port 10.

Note that when the suction step S1 is executed, the discharge step S5 is executed at the substantially same timing as that of the suction step S1 in the front operation chamber 15 on the front side of the blade 6. That is, air in the front operation chamber 15 is pressed by the blade 6, and is discharged to the outside through the exhaust port 12.

FIG. 6 is a view showing a compression step S2 and the expansion step S4 in the rotary blade engine 1.

Referring to FIG. 6, the compression step S2 will be described. After the air has been sucked into the operation chamber 14 by the suction step S1 (see FIG. 5), the compression step S2 of compressing the sucked air is performed.

Specifically, upon next rotation, i.e., second rotation, of the blade 6 having rotated once in the suction step S1, the exhaust valve 13 is closed, and the compression step S2 is executed in the front operation chamber 15. In the compression step S2, the air in the front operation chamber 15 is compressed by rotation of the blade 6.

Then, the compressed-air chamber inlet valve 22 is opened, and the air compressed by the blade 6 in the front operation chamber 15 is sent to the compressed-air chamber 21 through the inlet flow path 25.

Note that when the compression step S2 is performed in the front operation chamber 15, a later-described compressed-air sending step S3 and the later-described expansion step S4 are performed in the back operation chamber 16.

FIG. 7 is a view showing the compressed-air sending step S3.

Referring to FIG. 7, the compressed-air sending step S3 will be described. After the compression step S2 has been performed and the compressed air has been stored in the compressed-air chamber 21, the compressed-air sending step S3 of supplying the compressed air to the operation chamber 14 is performed.

Specifically, upon next rotation, i.e., third rotation, of the second rotation for performing the compression step S2, after the blade 6 has passed through the vicinity of the suction port 10 and the outlet flow path 26 in a state in which the suction valve 11, the exhaust valve 13, the compressed-air chamber inlet valve 22, the compressed-air chamber outlet valve 23, and the check valve 24 are closed, the compressed-air chamber outlet valve 23 and the check valve 24 are opened. Accordingly, the compressed-air chamber 21 and the back operation chamber 16 communicate with each other through the outlet flow path 26, and the compressed air is supplied from the compressed-air chamber 21 to the back operation chamber 16.

Note that in the compressed-air sending step S3, the compression step S2 of compressing the air in the operation chamber 14 is performed in the front operation chamber 15 on the front side of the blade 6. While the compressed-air sending step S3 is performed with the compressed-air chamber outlet valve 23 and the check valve 24 being opened, the compressed-air chamber inlet valve 22 of the compressed-air chamber 21 remains closed. Thus, the air compressed in the front operation chamber 15 by rotation of the blade 6 does not flow to the compressed-air chamber 21.

Then, when the blade 6 rotates to a predetermined position, the compressed-air chamber outlet valve 23 and the check valve 24 are closed, and the compressed-air sending step S3 is completed. After completion of the compressed-air sending step S3, the expansion step S4 is subsequently executed in the back operation chamber 16. That is, in the third rotation, the compressed-air sending step S3 of supplying the compressed air to the back operation chamber 16 and the expansion step S4 (FIG. 6) of expanding the compressed air are continuously performed by a single rotation.

Specifically, fuel is injected into the back operation chamber 16 from the fuel injection device 40, and ignition with the ignition plug 41 is performed (see FIG. 6). Accordingly, the pressure of air in the back operation chamber 16 increases by combustion (explosion) of the fuel, and by such air pressure, the blade 6 is pressed from the back side and the air is expanded. The air pressure obtained by such expansion is transmitted to the output shaft 5, and is output as the rotation power.

Note that the expansion step S4 is performed subsequently to the compressed-air sending step S3 in the back operation chamber 16 on the back side of the blade 6, and at this point, the compression step S2 of compressing the air in the operation chamber 14 is performed in the front operation chamber 15 on the front side of the blade 6. After the compressed-air sending step S3 has ended and the compressed-air chamber outlet valve 23 and the check valve 24 have been closed, the compressed-air chamber inlet valve 22 is opened. Thus, the air compressed in the front operation chamber 15 is sent to the compressed-air chamber 21 as described above.

After completion of the expansion step S4, the discharge step S5 is performed by next rotation, i.e., fourth rotation, of the blade 6. In the discharge step S5, the blade 6 rotates in a state in which the exhaust valve 13 is opened and the compressed-air chamber inlet valve 22 is closed, and accordingly, the air in the front operation chamber 15 is discharged through the exhaust port 12 (see FIG. 5).

Note that as already described, the discharge step S5 is performed at the substantially same timing as that of the suction step S1. That is, the blade 6 rotates in a state in which the suction valve 11 and the exhaust valve 13 are opened and the compressed-air chamber inlet valve 22, the compressed-air chamber outlet valve 23, and the check valve 24 are closed, and accordingly, the suction step S1 is executed in the back operation chamber 16 and the discharge step S5 is executed in the front operation chamber 15.

As described above, in the rotary blade engine 1, the suction step S1 is performed by the first rotation of the blade 6, the compression step S2 is performed by the second rotation, the compressed-air sending step S3 and the expansion step S4 are performed by the third rotation, and the discharge step S5 is performed by the fourth rotation (see FIGS. 5 to 7).

That is, the air is sucked into the back operation chamber 16 on the back side of the blade 6 from the suction port 10 by the first rotation of the blade 6, and by the second rotation of the blade 6, is compressed in the front operation chamber 15 on the front side of the blade 6 and is stored in the compressed-air chamber 21 by way of the inlet flow path 25.

Then, upon the third rotation of the blade 6, the compressed air stored in the compressed-air chamber 21 is re-sent to the back operation chamber 16 on the back side of the blade 6 and is expanded therein, thereby pressing the blade 6 to provide drive force. Then, the air expanded by the third rotation of the blade 6 is, upon the fourth rotation, discharged from the front operation chamber 15 on the front side of the blade 6 through the exhaust port 12.

Two steps are simultaneously executed in the back operation chamber 16 on the back side of the blade 6 and the front operation chamber 15 on the front side of the blade 6. Thus, the suction step S1 and the discharge step S5 can be executed by the first rotation of the blade 6, and the compression step S2, the compressed-air sending step S3, and the expansion step S4 can be executed by the second rotation of the blade 6 subsequent to the first rotation. Thus, the single expansion step S4 is performed for two rotations of the blade 6. Consequently, stable rotation output can be obtained.

As already described, the rotary blade engine 1 has no reciprocating power transmission mechanism as in a piston of a reciprocating engine of a typical technique. That is, the inner cylinder 4 forms the operation chamber 14, and makes rotary motion with floatably supporting the blade 6.

The blade 6 rotates about the output shaft 5 without reciprocating, and therefore, moves in the operation chamber 14 to press air in the operation chamber 14 and efficiently transmits the pressure of air in the operation chamber 14 to the output shaft 5. Thus, the rotary blade engine 1 of the present disclosure can rotate the output shaft 5 at high speed with less vibration than that of the reciprocating engine configured to reciprocate the piston, and can achieve high-efficiency energy conversion.

The rotary blade engine 1 of the present disclosure has no mechanism configured to revolve about the output shaft 5 while rotating as in a three-lobe rotor of a rotary piston engine of a typical technique. That is, the inner cylinder 4 of the present disclosure is in the cylindrical shape, rotates about the center axis X2 as the center of rotation, and rotates at the same position without moving about a changed position of the center of rotation. Thus, the inner cylinder 4 can stably rotate as compared to the three-lobe rotor of the rotary piston engine.

The rotary blade engine 1 of the present disclosure requires no complicated power transmission mechanism, such as an internal gear and an external gear, configured to transmit power to the output shaft 5 as in the rotary piston engine, and also requires no special high-accuracy curved surface processing such as a trochoid inner peripheral surface. That is, in the rotary blade engine 1, the inner cylinder 4 in the cylindrical shape rotates about the center axis X2 as the center of rotation, and the blade 6 is fixed to the output shaft 5 and rotates about the output shaft 5 as the center of rotation. Thus, the rotary blade engine 1 is configured such that no load is applied to the tip end portion of the blade 6. Consequently, the rotary blade engine 1 is easily processed as compared to the rotary piston engine of the typical technique, and is superior in terms of the productivity.

As described above, the rotary blade engine 1 according to the present embodiment can efficiently execute each of the suction, compression, expansion, and discharge steps in the operation chamber 14 by stable rotation of the inner cylinder 4 about the position eccentric from the output shaft 5 as the center of rotation and stable rotation of the blade 6 about the output shaft 5 as a rotation axis. Thus, the high-efficiency rotary blade engine 1 capable of converting the thermal energy of fuel into the rotation power for the output shaft 5 by stable operation with less vibration is provided.

Next, a rotary blade engine 101 according to another embodiment of the present disclosure will be described in detail with reference to FIG. 8.

Figure 8:
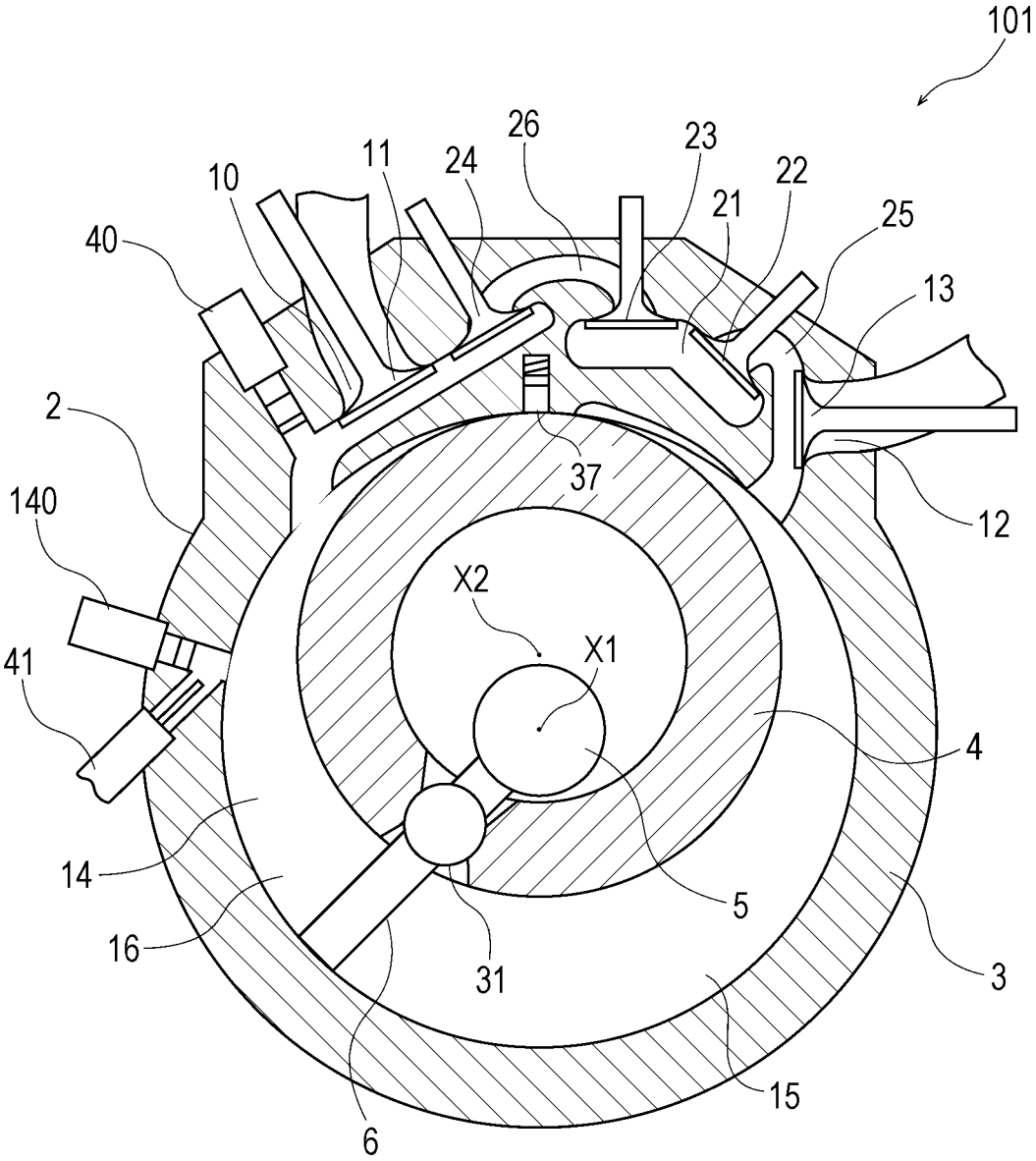
FIG. 8 is a front sectional view showing an outline configuration of a rotary blade engine according to another embodiment of the present disclosure.

FIG. 8 is a front sectional view showing an outline configuration of the rotary blade engine 101. Note that the same reference numerals are used to represent components having identical or similar features and effects to those of the embodiment already described above and description thereof will be omitted.

As shown in FIG. 8, the rotary blade engine 101 has two fuel injection devices 40, 140. That is, in a housing 2, the fuel injection device 40 configured to supply fuel to compressed air and the fuel injection device 140 configured to supply fuel to compressed air are provided. For example, one fuel injection device 40 may be a device configured to supply hydrogen gas as fuel, and the other fuel injection device 140 may be a device configured to supply gasoline as fuel.

Specifically, the fuel injection device 40 and the fuel injection device 140 are provided at an operation chamber 14 or an outlet flow path 26 in the vicinity of a suction port 10. In a case where one fuel injection device 40 is the device configured to supply hydrogen gas, the fuel injection device 40 may be provided to inject hydrogen gas into the outlet flow path 26. In a case where the other fuel injection device 140 is the device configured to supply gasoline, the fuel injection device 140 may be provided to inject gasoline into the operation chamber 14.

An ignition plug 41 configured to ignite fuel is provided downstream of the fuel injection device 40 and the fuel injection device 140. That is, in the above-described configuration in which the fuel injection device 40 supplies hydrogen gas and the fuel injection device 140 supplies gasoline, the ignition plug 41 is provided downstream of the fuel injection device 140 configured to supply gasoline, i.e., on a front side of the fuel injection device 140 in the direction of rotation of a blade 6, in the vicinity of the fuel injection device 140.

As described above, the fuel injection device 40 configured to inject hydrogen gas is provided at a position apart from the ignition plug 41, and the fuel injection device 140 configured to supply gasoline is provided in the vicinity of the ignition plug 41. Thus, hydrogen gas igniting fast can be safety ignited.

Specifically, after the blade 6 has passed through the vicinity of the outlet flow path 26, hydrogen gas is injected from the fuel injection device 40. After injection of the hydrogen gas from the fuel injection device 40 has ended, the blade 6 passes through the vicinity of the ignition plug 41, and ignition with the ignition plug 41 is performed. Thus, backfire into the fuel injection device 40 can be reduced, and the hydrogen gas can be safely combusted.

In the case of using gasoline fuel, the blade 6 passes through the vicinity of the fuel injection device 140, and thereafter, gasoline is injected from the fuel injection device 140. After the blade 6 has passed through the vicinity of the ignition plug 41, ignition with the ignition plug 41 is performed.

Note that it may only be required that fuel is supplied only from any one of the fuel injection device 40 or the fuel injection device 140. That is, for example, when the rotary blade engine 101 lacks fuel or runs out of fuel during operation, the rotary blade engine 101 can selectively use hydrogen gas supplied from the fuel injection device 40 or gasoline supplied from the fuel injection device 140 to safely perform combustion, thereby continuously outputting the rotation power.

Note that the rotary blade engines 1 and 101 may include a supercharger such as a turbocharger or a mechanical supercharger, which compresses air and sends the compressed air to the suction port 10.

Note that the present disclosure is not limited to the above-described embodiments and various changes can be made without departing from the gist of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A rotary blade engine comprising:
an outer cylinder;
an inner cylinder;
an output shaft;
an operation chamber; and
a blade,
wherein the outer cylinder has a cylindrical inner peripheral surface,
the inner cylinder has a cylindrical outer peripheral surface, is provided inside the outer cylinder, and rotates about a second center axis as a center of rotation, the second center axis being provided at a position eccentric from a first center axis of the inner peripheral surface of the outer cylinder,
the output shaft is inserted into the inner cylinder, and rotates about the first center axis of the inner peripheral surface of the outer cylinder as a center of rotation,
the operation chamber is formed between the inner peripheral surface of the outer cylinder and the outer peripheral surface of the inner cylinder, and
the blade is fixed to the output shaft, rotates together with the output shaft, and defines the operation chamber by floatably penetrating the inner cylinder from an inside of the inner cylinder and slidably contacting the inner peripheral surface of the outer cylinder,
wherein suction, compression, expansion, and discharge steps in the operation chamber are configured to be executed by rotation of the blade.

2. A rotary blade engine comprising:
an outer cylinder;
an inner cylinder;
an output shaft;
an operation chamber;
a blade;
a suction port;
an exhaust port;
a compressed-air chamber;
an inlet flow path; and
an outlet flow path,
wherein the outer cylinder has a cylindrical inner peripheral surface,
the inner cylinder has a cylindrical outer peripheral surface, is provided inside the outer cylinder, and rotates about a second center axis as a center of rotation, the second center axis being provided at a position eccentric from a first center axis of the inner peripheral surface of the outer cylinder,
the output shaft is inserted into the inner cylinder, and rotates about the first center axis of the inner peripheral surface of the outer cylinder as a center of rotation,
the operation chamber is formed between the inner peripheral surface of the outer cylinder and the outer peripheral surface of the inner cylinder,
the blade is fixed to the output shaft, rotates together with the output shaft, and defines the operation chamber by floatably penetrating the inner cylinder from an inside of the inner cylinder and slidably contacting the inner peripheral surface of the outer cylinder,
the suction port sucks combustion air into the operation chamber from an outside,
the exhaust port discharges expanded air from the operation chamber to the outside,
the compressed-air chamber stores air compressed in the operation chamber,
the inlet flow path is a flow path for air flowing into the compressed-air chamber from the operation chamber, and is connected to the operation chamber in a vicinity of the exhaust port,
the outlet flow path is a flow path for air supplied from the compressed-air chamber to the operation chamber, and is connected to the operation chamber in a vicinity of the suction port, and
the air compressed in the operation chamber flows into and is stored in the compressed-air chamber by way of the inlet flow path, is sent to the operation chamber by way of the outlet flow path, and is expanded in the operation chamber.

3. The rotary blade engine according to claim 2, further comprising:
a suction valve provided at the suction port;
an exhaust valve provided at the exhaust port;
a compressed-air chamber inlet valve provided at the inlet flow path; and
a compressed-air chamber outlet valve provided at the outlet flow path.

4. The rotary blade engine according to claim 3, wherein
a check valve configured to reduce a backflow of the air flowing into the compressed-air chamber from the operation chamber is provided at the outlet flow path.

5. The rotary blade engine according to claim 3, wherein
the suction valve, the exhaust valve, the compressed-air chamber inlet valve, and the compressed-air chamber outlet valve are electromagnetic driving valves.

6. The rotary blade engine according to claim 3, wherein
the blade divides the operation chamber into a front operation chamber positioned on a front side in a direction of rotation of the blade and a back operation chamber positioned on a back side in the direction of rotation of the blade,
in first rotation of the blade, in a state in which the suction valve and the exhaust valve are opened and the compressed-air chamber inlet valve and the compressed-air chamber outlet valve are closed, a suction step of causing air to flow into the back operation chamber from the suction port is executed, and a discharge step of discharging the air from the front operation chamber to the exhaust port is executed, in second rotation of the blade, in a state in which the suction valve, the exhaust valve, and the compressed-air chamber inlet valve are closed and the compressed-air chamber outlet valve is opened, the compressed air is supplied from the compressed-air chamber to the back operation chamber, and a compression step of compressing the air in the front operation chamber is started, and subsequently, in a state in which the compressed-air chamber outlet valve is closed and the compressed-air chamber inlet valve is opened, an expansion step of expanding the air compressed in the back operation chamber is executed, the compression step is executed in the front operation chamber, and the compressed air is sent to the compressed-air chamber.

* * * * *